US007325499B2

(12) United States Patent
Jensen et al.

(10) Patent No.: US 7,325,499 B2
(45) Date of Patent: Feb. 5, 2008

(54) CONSTANT CONTACT SIDE BEARING ASSEMBLY FOR A RAILCAR

(75) Inventors: Erik D. Jensen, Batavia, IL (US); William P. O'Donnell, Aurora, IL (US); Paul B. Aspengren, Elmhurst, IL (US)

(73) Assignee: Miner Enterprises, Inc., Geneva, IL (US)

( * ) Notice: Subject to any disclaimer, the term of this patent is extended or adjusted under 35 U.S.C. 154(b) by 291 days.

(21) Appl. No.: 11/147,076

(22) Filed: Jun. 7, 2005

(65) Prior Publication Data

US 2005/0223935 A1 Oct. 13, 2005

Related U.S. Application Data

(63) Continuation-in-part of application No. 10/785,097, filed on Feb. 24, 2004, now Pat. No. 6,957,611.

(51) Int. Cl.
*F16F 1/36* (2006.01)

(52) U.S. Cl. ..... 105/199.3; 384/423

(58) Field of Classification Search ..... 105/199.3, 105/199.1; 384/423; 267/3, 269, 292
See application file for complete search history.

(56) References Cited

U.S. PATENT DOCUMENTS 2,301,372 A * 11/1942 Cottrell ..... 384/422
3,556,503 A * 1/1971 van Moss, Jr. ..... 276/3
3,735,711 A 5/1973 Hassenauer
3,910,655 A 10/1975 Willison et al.
3,915,520 A 10/1975 Hassenauer
3,957,318 A 5/1976 Wiebe
4,355,583 A 10/1982 Eggert, Jr.
4,567,833 A 2/1986 Hanson
4,793,720 A 12/1988 Merker
4,988,997 A 3/1991 Carlson
5,048,427 A 9/1991 Dumoulin
5,086,707 A * 2/1992 Spencer et al. ..... 105/199.3
5,386,783 A 2/1995 Rhen et al.
5,601,031 A 2/1997 Carlson (Continued)

OTHER PUBLICATIONS

Miner Enterprises, Inc.; TecsPak Constant Contact Sidce Bearings;1996; 2 pages; Geneva, Illinois, USA.
Miner Enterprises, Inc.; Constant Contact Side Bearing Retrofit Kit; undated; 2 pages; Geneva, Illinois, USA.

*Primary Examiner*—Mark T. Le
(74) *Attorney, Agent, or Firm*—John W. Harbst

(57) ABSTRACT

A constant contact side bearing assembly configured for insertion into a walled receptacle provided on an upper surface of a railcar bolster. The side bearing assembly includes a housing assembly including a base and cap receivable within the open top walled receptacle on the bolster. The base has laterally spaced sides and longitudinally spaced ends. The cap is guided for movements relative to the base and has a generally flat railcar body engaging portion along with structure which combines with the sides and ends on the base to define an internal void for the side bearing assembly. A longitudinally elongated and generally rectangularly-shaped elastomeric compression spring is arranged in the internal void within the side bearing assembly for absorbing, dissipating, and returning energy imparted to the side bearing assembly during a work cycle. During a side bearing assembly work cycle, the spring is configured to deform in a predetermined manner and such that, upon maximum spring deformation, the spring maintains an operable relationship relative to the housing assembly of the side bearing assembly.

21 Claims, 3 Drawing Sheets

U.S. PATENT DOCUMENTS 5,957,441 A 9/1999 Tews
6,092,470 A 7/2000 O'Donnell
6,957,611 B2 * 10/2005 O'Donnell et al. ..... 384/423
7,152,534 B2 * 12/2006 O'Donnell et al. ..... 105/199.3

* cited by examiner

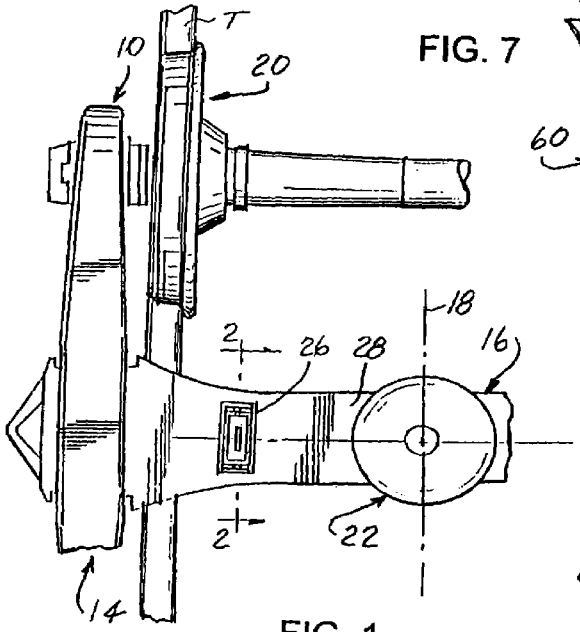
FIG. 1
FIG. 7
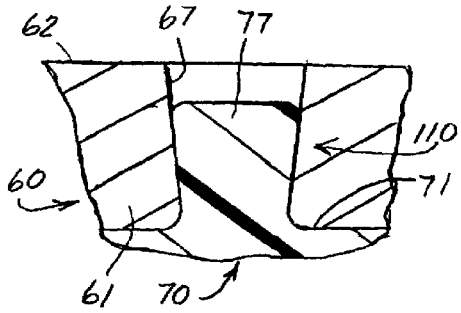
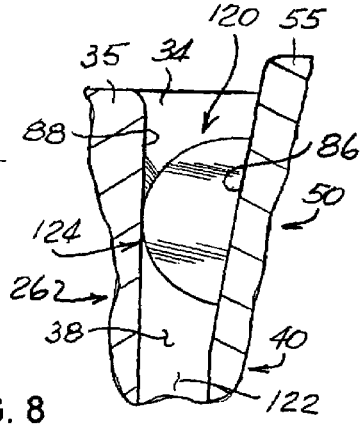
FIG. 8
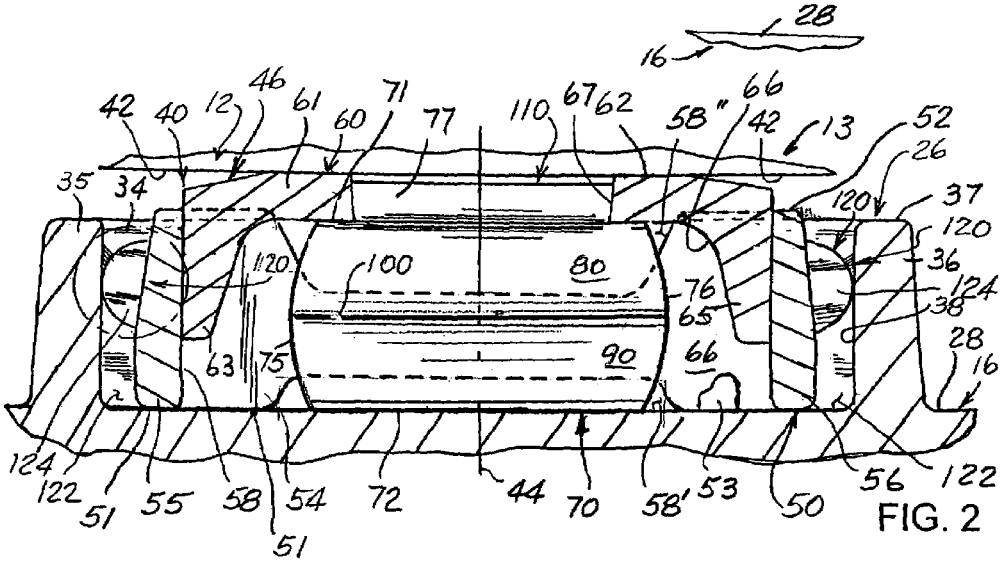
FIG. 2

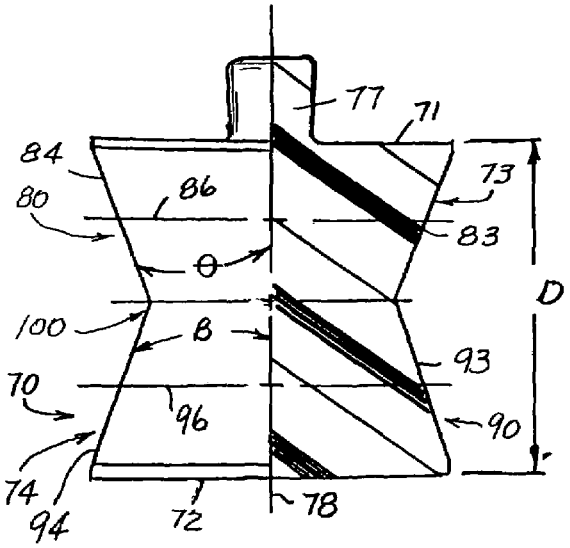
FIG. 5
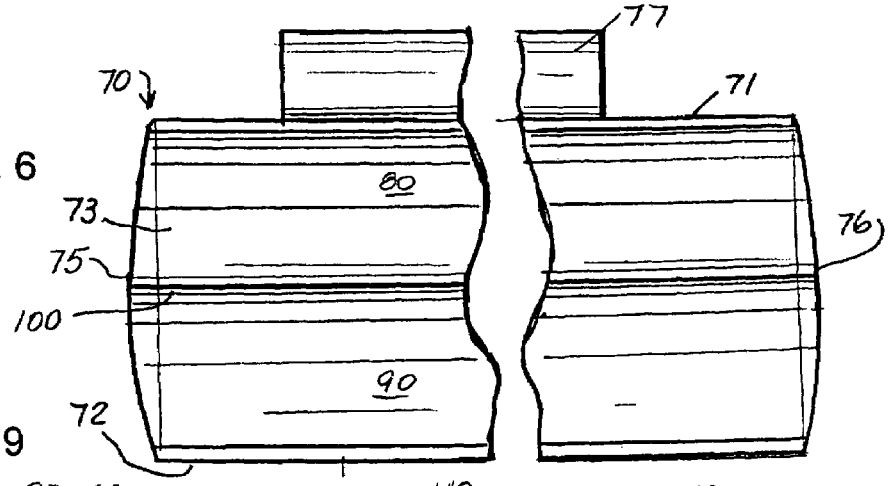
FIG. 6
FIG. 9
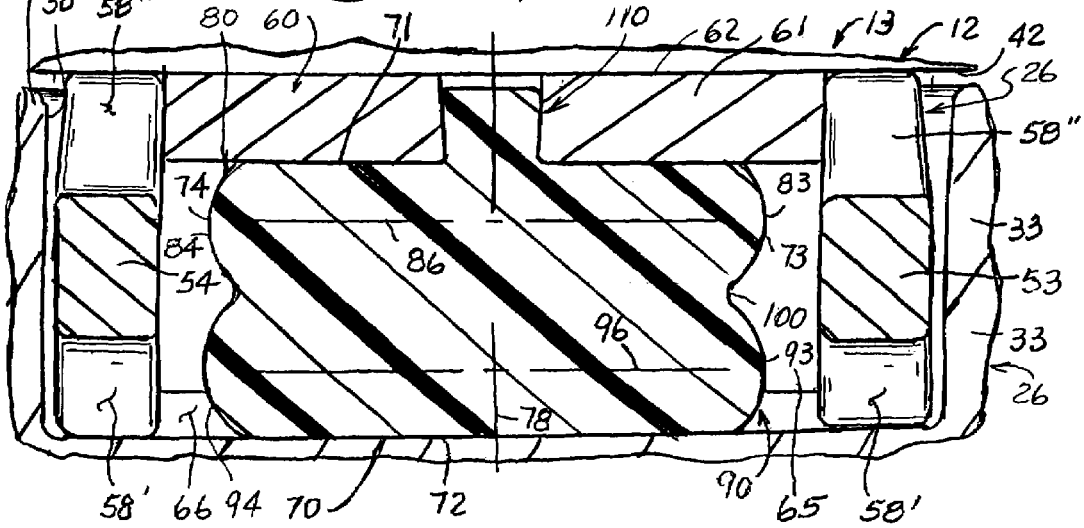

CONSTANT CONTACT SIDE BEARING ASSEMBLY FOR A RAILCAR

RELATED APPLICATION

This application is a Continuation-In-Part patent application to U.S. patent application Ser. No.: 10/785,097; filed Feb. 24, 2004; now U.S. Pat. No. 6,957,611.

FIELD OF THE INVENTION

The present disclosure generally relates to railcars and, more particularly, to a constant contact side bearing assembly for a railcar.

BACKGROUND OF THE INVENTION

On a railcar, wheeled trucks support opposite ends of a railcar body for movement over tracks. Each truck includes a bolster extending essentially transversely of the car body longitudinal centerline. In the preponderance of freight cars, a pivotal connection is established between the bolster and railcar body by center bearing plates and bowls transversely centered on the car body underframe and the truck bolster. Accordingly, the truck is permitted to pivot on the center bearing plates under the car body. As the railcar moves between locations, the car body also tends to adversely roll from side to side.

Attempts have been made to control the adverse roll of the railcar body through use of side bearings positioned on the truck bolster outwardly of the center bearing plates. A "gap style" side bearing has been known to be used on slower moving tank/hopper railcars. Conventional "gap style" side bearings include a metal, i.e. steel, block or pad accommodated within an elongated open top pocket or recess defined on the truck bolster. An elongated and upstanding housing or cage, integrally formed with or secured, as by welding or the like, to an upper surface on the truck bolster defines the open top recess and inhibits sliding movement of the metal block relative to the bolster. The recesses provided on the bolster can, and often do, differ in size relative to each other. As is known, a gap or vertical space is usually present between the upper surface of the "gap style" side bearing and the underside of the railcar body.

Other conventional "gap style" side bearings have included roller bearings carried for rolling movements within the elongated housing or carrier mounted on the upper surface of the railcar bolster. The roller extends above an uppermost extent of the housing or carrier and engages with an underside of the railcar body. Such side bearings are able to support the railcar body with respect to the bolster while at the same time permitting the bolster, and therefore the truck, freedom to rotate with respect to the car body as is necessary to accommodate normal truck movements along both straight and curved track.

Under certain dynamic conditions, combined with lateral track irregularities, the railcar truck also tends to oscillate or "hunt" in a yaw-like manner beneath the car body. The coned wheels of each truck travel a sinuous path along a tangent or straight track as they seek a centered position under the steering influence of the wheel conicity. As a result of such cyclic yawing, "hunting" can occur as the yawing becomes unstable due to lateral resonance developed between the car body and the truck. As will be appreciated, excessive "hunting" can result in premature wear of the wheeled truck components including the wheels, bolsters, and related equipment. Hunting can also furthermore cause damage to the lading being transported in the car body.

Track speeds of rail stock, including tank/hopper cars, continue to increase. Increased rail speeds translate into corresponding increases in the amount of hunting movements of the wheeled trucks. As will be appreciated, "gap style" or those side bearings including roller bearings cannot and do not limit hunting movements of the wheeled trucks. As such, the truck components including the wheels, bolsters, and related equipment tend to experience premature wear.

The art has also contemplated constant contact side bearings for railcars. Constant contact railcar side bearings not only support a railcar body with respect to the bolster during relative rotational movements therebetween but additionally serve to dissipate energy through frictional engagement between the underside of the railcar body and a bearing element thereby limiting destructive truck hunting movements. Most constant contact side bearings typically include a housing assembly including a base and a cap. The base usually has a cup-like configuration and includes at least two apertured flanges, extending in opposed radial directions relative to each other, permitting the base to be suitably fastened to the bolster. In one form, the cap is biased from the base and includes an upper surface for contacting and rubbing against a car body underside. As will be appreciated, the cap is free to vertically move relative to the side bearing base. Such constant contact side bearings furthermore include a spring.

The purpose of such spring is to absorb, dissipate, and return energy imparted thereto during a work cycle of the side bearing assembly and resiliently position the upper surface of the cap, under a preload force, into frictional contact with the car body underframe. The spring for such side bearings can comprise either spring loaded steel elements or elastomeric blocks or a combination of both operably positioned between the side bearing base and the cap. An elastomeric block which has been found particularly beneficial is marketed and sold by the Assignee of the present disclosure under the tradename "TecsPak." As will be appreciated, however, such an elastomeric block, by itself, lacks longitudinal stiffness and, thus, requires surrounding housing structure to provide added support and stiffness thereto.

Known constant contact side bearings are simply not designed to fit or be accommodated within existing pockets or recesses on a truck bolster of a railcar. The attachment flanges or lugs radially extending from opposed sides of the housing structure or base consume valuable space and inhibit such a known bearing assembly from fitting into the open top recess defined by the cage or carrier present on the railcar truck bolster. Accordingly, to use a constant contact side bearing on railcar having a bolster with a recess defined by such cage or carrier requires either replacement of the entire truck bolster or complete removal of the upstanding housing or cage, defining the pocket, from the surface of the bolster to which the attachment flanges or lugs of the side bearing are normally secured. Either proposal requires extensive manual efforts and, thus, is expensive while keeping the railcar out of revenue service for an extended time period.

Although usable with a solid steel block or roller bearings, the restrictive space constraints inherent with the open top cage or carrier on a railcar bolster are a significant concern when considering fitting a constant contact railcar side bearing assembly into such structure. As known, an elastomeric spring deforms outwardly when a compressive load is placed thereon and requires substantial space around it for lateral or radial expansion or deformation. As will be appreciated, without adequate space surrounding the elastomeric spring, the radial deformation of the elastomeric spring, resulting from axial compression thereof, may cause the periphery of the elastomeric spring to press against the surrounding side bearing housing structure which could result in "stiction", and a substantial increase in the spring rate, and, in some instances, irreparable damage to the surrounding side bearing housing structure.

When considering use of a railroad car side bearing in a recess defined by a cage on a railcar bolster only limited space is available. That is, the size of the recess defined by the cage on the railcar bolster restricts the size of the side bearing assembly and, thus, the size of the elastomeric spring which can arranged in combination therewith. Of course, restricting spring size likewise restricts the force capable of being developed by such spring. If the spring arranged in combination with the railcar side bearing assembly is too small, the force capable of being developed by such spring may be insufficient to permit the side bearing assembly from exerting the required force against the underside of the car body to prevent rolling movements and inhibit "hunting" movements of the associated wheeled railcar truck. Also, the space consumed by the side bearing housing, arranged in surrounding relation relative to the elastomeric spring, still furthermore reduces the size of the envelope for accommodating such a spring thus adversely affecting the preload force required to be developed by the railroad car side bearing.

Some railcar designs further exacerbate the problem of fitting a constant contact side bearing thereto. In many railcar designs, the side bearing operates within a five and one-sixteenth inch nominal working space between the truck bolster and the car body underside. Such dimension usually provides sufficient space for the spring to develop the required preload force for the side bearing. In other railcar designs (i.e., tank/hopper railcars), however, the vertical space between the bolster, to which the side bearing is secured, and the car body underside is severely restricted. In fact, some railcar designs provide only about a two and five-eights inch nominal working space between the truck bolster and the underside of the railcar. The reduced work space envelope provided on many railcar designs is too limited to accommodate a constant contact side bearing designed to develop sufficient force to control such hunting movements.

Additionally, heat buildup in proximity to an elastomeric spring of constant contact side bearings is a serious concern. While advantageously producing an opposite torque acting to inhibit the yaw motion of the truck, the resulting friction between the side bearing and underside of the car body develops an excessive amount of heat. The repetitive cyclic compression of the elastomeric block coupled with high ambient temperatures, in which some railcars operate, further exacerbate spring deformation. As will be appreciated, such heat buildup often causes the elastomeric block to soften/deform, thus, significantly reducing the ability of the side bearing to apply a proper preload force whereby decreasing vertical suspension characteristics of the side bearing resulting in increased hunting.

Thus, there is a continuing need and desire for a constant contact railcar side bearing assembly including an elastomeric spring capable of developing the force necessary to accomplish those goals mentioned above and wherein the elastomeric spring and railcar side bearing are configured to fit within only those limited space constraints provided by the open top cage or carrier on the railcar truck bolster.

SUMMARY OF THE INVENTION

In view of the above, and in accordance with one aspect, there is provided a constant contact side bearing assembly for a railcar having a body, with the side bearing assembly being adapted to be accommodated within a receptacle defining an elongated and open top recess. The open top receptacle includes a pair of laterally spaced sidewalls rigidly joined to a pair of longitudinally spaced endwalls, with the sidewalls and endwalls of the receptacle being arranged in upstanding relation relative to a bolster on which the body of the railcar is carried. The constant contact side bearing assembly includes a base configured to be accommodated within the recess defined by the receptacle on the bolster. The base includes a pair of laterally spaced sides, adapted to extend generally parallel to the sidewalls on the receptacle and which are rigidly joined to a pair of longitudinally spaced ends adapted to extend generally parallel to the endwalls on the receptacle. The sides and ends of the base define a closed marginal edge for an open top cavity, generally rectangular in plan, and having four corners. A friction member is guided for movements relative to the base and has a generally flat upper portion adapted to be biased against an underside of the railcar body after the side bearing assembly is arranged in operable combination with the railcar. An elastomeric spring, generally rectangular in plan, is adapted to be nested within the open top cavity defined by and between the sides and ends of the base for absorbing, dissipating and returning energy imparted to the friction member during a work cycle of the side bearing assembly. The elastomeric spring is configured to deform in a predetermined manner horizontally toward the four corners of the marginal edge defining the cavity while deformation of exterior sides of the spring is restrained so as to maintain an operable relationship between the spring and the sides of the base during a work cycle of the side bearing assembly.

In a preferred form, the friction member and elastomeric spring are arranged in interlocking relation relative to each other. Preferably, an apparatus, operably engagable with the receptacle on the bolster and the side bearing assembly base, locates the side bearing assembly relative to the bolster. In one form, the base of the side bearing assembly is configured to allow one end of the spring to extend therethrough so as to permit the spring top engage with that surface on the railcar bolster surrounded by the receptacle.

In one form, the elastomeric spring includes a laterally widened upper portion, extending the length of the spring, and a laterally widened lower portion likewise extending the length of the spring. Moreover, the elastomeric spring includes a laterally narrowed midportion, extending the length of the spring and along which the upper and lower portions of the spring are joined. Preferably, the upper and lower portions of the spring are generally symmetrical relative to a vertical axis extending generally normal to a surface on the bolster engaged by one end of the spring. In one form, the upper and lower portions of the spring each define a minor axis extending generally normal to the vertical axis and along which the spring deforms under compression. So as to maximize the efficient use of space within the confines of the defined by and between the sides and ends of the side bearing assembly base, the minor axes of the upper and lower portions of the elastomeric spring are each arranged in predetermined relation relative to the sides on the base of the side bearing assembly.

According to another aspect, there is provided a constant contact side bearing assembly adapted for insertion between a railcar body and a railcar bolster supporting the railcar body. An upper bolster surface has an open top receptacle thereon for accommodating the constant contact side bearing assembly. The constant contact side bearing assembly includes a walled housing, generally rectangular in plan, which is receivable within the open top receptacle on the bolster. The walled housing of the side bearing assembly has laterally spaced sides and longitudinally spaced ends defining a four cornered marginal edge, generally rectangular in plan, of an open top cavity. A cap is arranged in operable relation relative to the walled housing. The cap has a generally flat railcar body engaging portion and structure which, during a work cycle of the side bearing assembly, combines with the sides and ends on the walled housing to telescopically guide the cap relative to the walled housing. A longitudinally elongated and generally rectangularly-shaped elastomeric spring is receivable within the cavity defined by the walled housing for absorbing, dissipating and returning energy imparted to the side bearing assembly. An upper surface of the spring engages an underside of the railcar engaging portion of the cap so as to resiliently and continually urge the flat railcar engaging portion of the cap against the car body. The elastomeric spring is configured relative to the laterally spaced sides and ends of the walled housing such that the spring deforms in a predetermined manner horizontally outward toward the four corners of the marginal edge defining the cavity while exterior sides of the spring are maintained in an operable relationship relative to the sides of the side bearing assembly walled housing during a work cycle of the side bearing assembly.

In one form, the walled housing of the side bearing assembly is open at a top and bottom thereof so as to allow one end of the elastomeric spring to extend therethrough and abuttingly engage with the upper surface of said bolster whereby minimizing a distance between the flat railcar engaging portion of said cap and the upper surface of said bolster. Preferably, the constant contact side bearing assembly further includes an apparatus for locating and securing the side bearing assembly within the walled receptacle on the railcar bolster. Moreover, the generally flat railcar body engaging portion on the cap and an upper end of the spring are preferably configured with interlocking instrumentalities for securing the elastomeric spring and cap in operable combination relative to each other.

In a preferred form, the elastomeric spring has a widened upper portion with laterally spaced first and second sides extending generally parallel to the sides on the walled housing, a widened lower portion with laterally spaced first and second sides extending generally parallel to the sides on the walled housing, and a narrowed waist portion extending between and joining the upper and lower portions of the spring to each other. In this embodiment, the waist portion of the spring is vertically positioned such that, lateral expansion or deformation of the widened upper and lower portions of the spring is controlled in a predetermined relation relative to the sides of the walled housing on the side bearing assembly.

In one form, the combined vertical heights of the first portion, the second portion and the waist portion comprise between about 75% to about 90% of a distance between upper and lower surfaces of the uncompressed elastomeric spring. Preferably, the sides on the widened upper portion of the elastomeric spring extend from the waist portion and angularly diverge relative each other at a predetermined angle toward the upper side of and along the length of the spring as long as a limited load is vertically placed on the spring. Moreover, in one form, the sides of the widened lower portion of the elastomeric spring extend from the waist portion and angularly diverge relative to each other at a predetermined angle and toward the lower side of and along the length of the spring as long as a limited is vertically placed on the spring.

In one embodiment, the first and second sides of the upper portion of the elastomeric spring and the first and second sides of the lower portion of the elastomeric spring are generally symmetrical relative to each other. Preferably, the elastomeric spring is formed from a thermoplastic material having an elastic strain to plastic strain ratio greater than 1.5 to 1.

According to another aspect, there is provided a constant contact side bearing assembly configured for insertion into an upwardly open walled receptacle on a railcar bolster connected to a wheeled truck and which supports a railcar body. The constant contact side bearing assembly includes a housing assembly having a generally rectangular configuration in plan and which is configured to loosely fit within the walled receptacle on the bolster. The housing assembly defines and internal void having a closed margin, generally rectangular in plan, and further includes a pair of laterally spaced generally parallel sides and an upper friction surface. An elastomeric compression spring is operably fitted within the internal void defined by the housing assembly for resiliently biasing the upper friction surface against an underside of the railcar body to limit hunting movements of the wheeled truck. The elastomeric spring has a generally rectangular configuration in plan and includes a pair of elongated and laterally spaced sides which generally parallel the laterally spaced sides on the housing assembly after the elastomeric spring is arranged in operable combination with the housing assembly. The sides of the spring are configured in positional relation relative to the sides on the housing assembly such that, upon spring deformation, volumetric displacement of the spring relative to the marginal edge of the internal void defined by the housing assembly and the sides of the housing assembly is controlled in a predetermined manner to optimize load absorption capability for the constant contact side bearing assembly. An apparatus is also provided for locating and securing the housing assembly within the walled receptacle on the railcar bolster.

In one form, the elastomeric compression spring has upper and lower surfaces along with an upper portion comprising approximately 30% to about 45% of a distance between the upper and lower surfaces of the spring. The elastomeric spring further has a lower portion comprising approximately 30% to about 45% of the distance between the upper and lower surfaces of the compression spring, and a reduced waist portion extending between and joining the upper and lower portions of the compression spring to each other. Notably, the waist portion of the spring is elevationally positioned relative to the sidewalls on the side bearing housing such that, upon spring deformation, the lateral expansion or deformation of the upper and lower portions on the spring is controlled in a predetermined relation relative to with the sides of the housing assembly.

Each side of the elastomeric spring preferably has a generally concave configuration in elevation as long as a limited or no load is vertically placed on the spring. In one form, the elastomeric spring is formed from a thermoplastic material having an elastic strain to plastic strain ratio greater than 1.5 to 1.

In one form, the railcar side bearing assembly has a measurable distance ranging generally between about 2.5 inches and about 4.5 inches between an upper extreme of the side bearing assembly and the bolster surface after the side bearing assembly is accommodated in the receptacle on the bolster. Because of concerns related to the adverse effects of heat on elastomers, the bearing assembly is preferably configured to promote the dissipation of heat away from the elastomer compression spring.

In view of the above, one feature of the present disclosure relates to the provision of a constant contact side bearing assembly designed and configured to be accommodated within an existing pocket defined by an open top receptacle on a railcar bolster.

Another feature of the present disclosure relates to the provision of a constant contact side bearing assembly configured to be accommodated within a limited vertical space of less than 4.5 inches for stabilizing a railcar body.

Yet another feature of the present disclosure relates to the provision of a railcar side bearing assembly employing an elastomeric block as the cushioning medium and which is structured to dissipate heat from the side bearing assembly during operation.

These and additional features, aims and advantages of the present disclosure will become more readily apparent from the drawings, detailed description, and the appended claims.

BRIEF DESCRIPTION OF THE DRAWINGS

FIG. 1 is a top plan view of a portion of a railcar wheeled truck including a side bearing assembly embodying principals of the present disclosure;

FIG. 2 is a longitudinal sectional view taken along line 2-2 of FIG. 1;

FIG. 5 is an enlarged end view of an elastomeric spring forming part of the present disclosure;

FIG. 6 is an enlarged fragmentary front view of the spring shown in FIG. 5;

FIG. 7 is an enlarged view showing that area encircled in FIG. 4;

FIG. 8 is an enlarged view showing of that area encircled in FIG. 2; and FIG. 9 is an enlarged sectional view, similar to FIG. 4, but illustrating a different operating condition for the side bearing assembly of the present disclosure.

DETAILED DESCRIPTION OF THE INVENTION

Figure 3:
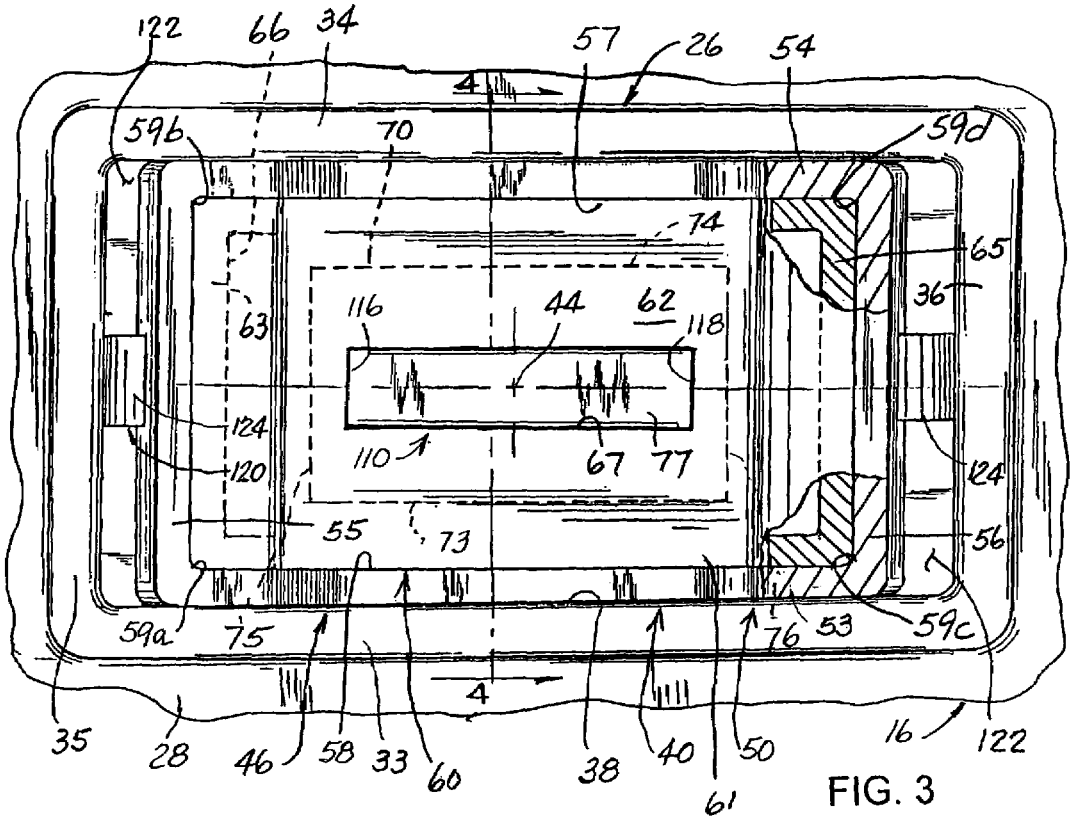
FIG. 3 is an enlarged top plan view of one embodiment of a side bearing assembly embodying principals of the present disclosure.

While the present disclosure is susceptible of embodiment in multiple forms, there is shown in the drawings and will be described a preferred embodiment, with the understanding the present disclosure sets forth an exemplification of one form of constant contact side bearing assembly which is not intended to limit the disclosure to the specific embodiment illustrated and described.

Referring now to the drawings, wherein like reference numerals indicate like parts throughout the several views, FIG. 1 shows a portion of a railcar wheeled truck assembly, generally indicated by numeral 10, which supports and allows a body 12 (FIG. 2) of a railcar 13 (FIG. 2) to ride along and over tracks T. Truck assembly 10 is of a conventional design and includes a side frame 14, a bolster 16, extending generally transversely relative to a longitudinal centerline 18 of the railcar body 12, and a wheel set 20. A conventional center bearing plate 22 is suitably mounted on the bolster 16 for pivotally supporting one end of the car body 12.

On opposite lateral sides of the bearing plate 22, the bolster 16 of the illustrated truck assembly has a conventional box-like shaped receptacle or housing 26 (with only one housing being shown). Each box-like receptacle or housing 26 is either formed integral with or secured, as by welding or the like, to project upwardly from an upper surface 28 of the bolster 16 and can take different forms. In the version illustrated in FIG. 3, housing 26 has wall structure including a pair of generally parallel and laterally spaced side walls 33 and 34 and a pair of generally parallel and longitudinally spaced end walls 35 and 36. The upper ends or extremes 37 of walls 33, 34, 35 and 36 terminate a predetermined distance above the upper bolster surface 28. Moreover, and in the form shown, the wall structure on housing 26 defines an open top recess or pocket 38.

The end walls 35, 36 of housing 26 are typically spaced apart a further distance than are the side walls 33, 34 such that the margin of the recess 38 is generally rectangular in plan; with a length thereof extending generally longitudinally and generally parallel to the axis 18 (FIG. 1). The length of each cavity or recess 38 defined by the receptacle 26 can vary between each other and between railcars. Suffice it to say, the elements and structures set forth above are well known in the art and a further description of such elements and structures will not be further set forth except where necessary for a complete understanding of the present disclosure.

Figure 4:
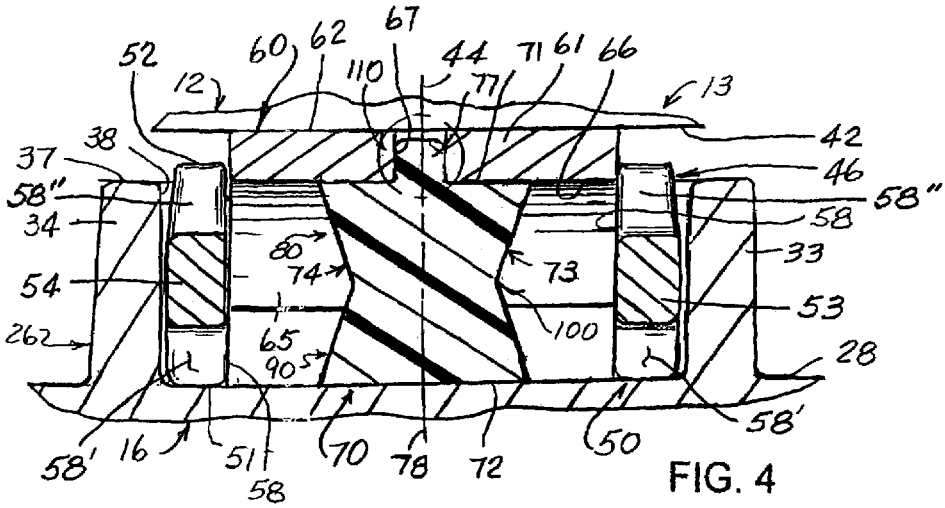
FIG. 4 is a sectional view taken along line 4-4 of FIG. 3.

A constant contact side bearing assembly 40, according to the present disclosure, is designed to be accommodated within the recess 38 defined by each receptacle 26 on the bolster 16 for supporting and frictionally engaging an underside 42 of the railcar body 12 (FIGS. 2 and 4). As shown in FIG. 2, and after being arranged in operable combination with the bolster 16, bearing assembly 40 defines an axis 44 extending generally normal to bolster surface 28. The side bearing assembly 40, illustrated for exemplary purposes, is designed with a low profile. It should be appreciated, however, the principals of this disclosure equally apply to railcar side bearings configured to operate in combination with railcars having a standard nominal working space of about five and one-sixteenth inch between the truck bolster and the car body underside. Suffice it to say, bearing assembly 40 has a housing assembly 46, including a base or cage 50 and a cap or friction member 60, along with a longitudinally elongated compression spring 70 accommodated within the housing assembly 46 for absorbing, dissipating and returning energy imparted to the side bearing assembly 40 during a work cycle.

Preferably, the base or cage 50 of the side bearing assembly 40 is formed from metal and, as shown in FIG. 3, has upstanding wall structure preferably configured to loosely fit within the receptacle 26 on the railcar bolster 16. Returning to FIG. 2, the wall structure of base 50 includes elongated and generally parallel sides 53 and 54 disposed to opposed lateral sides of the bearing assembly axis 44 and a pair of generally parallel and spaced ends 55 and 56 disposed to opposed longitudinal sides of the bearing assembly axis 44. In the illustrated form, the sides 53, 54 of base 50 are connected and preferably formed integral with the ends 55, 56. As shown in FIG. 3, the sides 53, 54 and ends 55, 56 of base 50 combine to define a closed marginal edge 57 extending about and defining an open top cavity 58 for accommodating the compression spring 70. As shown in FIG. 3, the marginal edge 57 defining cavity 58 is longitudinally elongated and generally rectangular in plan and has four corners 59*a*, 59*b*, 59*c* and 59*d*.

Preferably, the lateral distance between the outer surfaces of sides 53, 54 of base 50 is slightly less than the lateral distance between inner surfaces of the side walls 33, 34 of the receptacle 26 into which side bearing assembly 40 is to be fitted whereby limiting lateral or sideways movements of the bearing assembly 40. As such, the housing assembly 46 of side bearing assembly 40 is loosely accommodated within pocket 38 of receptacle 26 with a lower edge 51 (FIGS. 2 and 4) of base 50 being allowed to sit on or abut against bolster surface 28 following insertion of the side bearing assembly 40 into the bolster receptacle 26. As shown in FIGS. 2 and 4, and with the lower edge 51 of the side bearing assembly base 50 sitting on or abutting with the railcar bolster surface 28, the wall structure of the side bearing assembly base 50 is configured such that an upper edge 52 thereof preferably extends or projects above the upper edge 37 of the walls 33, 34, 35 and 36 of the open top receptacle 28. In a most preferred form, the upper ends or limits of the walls 53, 54, 55 and 56 of the side bearing assembly base 50 are equidistantly spaced from the railcar bolster surface 28 and are generally coplanar to each other.

In one form, the base 50 has an open bottom side or end to reduce the vertical profile or height of the side bearing assembly 40. In this form, and as shown in FIGS. 2 and 4, the cavity 58 defined by base 50 extends therethrough. Accordingly, one end of spring 70 is permitted to abuttingly engage the upper surface 28 of the railcar bolster 16, thus, reducing the height profile for the side bearing assembly 40.

In a preferred embodiment, wall structure of base 50 is configured to promote air flow through the bearing assembly 40. As shown in FIGS. 2 and 4, each side 53, 54 of base 50 is configured to promote the flow of air through the bearing assembly 40 while maintaining sufficient integrity to withstand the forces imparted to the base 50 during its operation on the railcar. After being arranged in operable combination with the cap or friction member 60, each side 53, 54 of base 50 is dimensionally designed relative to the ends 55, 56 such that at least a lengthwise portion of each side 53, 54 on base 50 defines an opening 58' between a lower surface on each side 53, 54 and the lower edge 51 of base 50. Preferably, the sides 53, 54 are further configured such that an opening 58" is provided between an upper surface on each side 53, 54 and an underside of friction member 60. As will be appreciated, the above-described configuration of the side bearing assembly base 50 yields significantly greater strength to the base 50 in a longitudinal direction as compared to the lateral direction.

The cap or friction member 60 is also preferably formed from metal. Cap 60 overlies and transmits energy to the spring 70 during a work cycle of the bearing assembly 40. As shown in FIGS. 2 and 4, cap 60 has a top plate 61 defining a generally flat upper surface 62 for frictionally engaging and establishing metal-to-metal sliding contact with the car body underside 42. In one form, cap 60 includes wall structure depending from and preferably formed integral with the top plate 61. In one form, the depending wall structure on cap 60 cooperates with the upstanding wall structure on base 50 to guide cap 60 for generally coaxial movements relative to housing 50. Moreover, and as will be appreciated, when arranged in operable combination relative to each other, base 50 and cap 60 combine to define an internal void or cavity 66 within the housing assembly 46 of the bearing assembly 40 for accommodating spring 70. As will be appreciated, other arrangements between base 50 and cap or friction member 60 are also possible without detracting or departing from the spirit and scope of the present disclosure.

In the embodiment illustrated in FIGS. 2, 3 and 4, the depending wall structure on cap 60 is comprised of a pair of longitudinally spaced ends 63 and 65 which are connected to and depend from the top plate 61. The depending wall structure on cap 60 is configured to complement and operably cooperate with the marginal edge 57 (FIG. 3) of the cavity 58 defined by base 50 whereby inhibiting horizontal shifting movements of the cap 60 relative thereto. As shown in FIG. 3, and when the spring 70 is arranged in operable combination with assembly 40, the free or terminal ends of the ends 63, 65 of cap 60 are vertically spaced from the upper bolster surface 28 a greater distance than is measurable between the car body underside 42 and the upper edge 52 of the wall structure of base 50. This design allows the side bearing assembly 40 to "go solid" when the car body underside 42 presses downwardly with sufficient force or energy against the side bearing assembly 40 so as to overcome the force or load capable of being exerted by spring 70 and engages against the upper edge 52 of the wall structure of base 50.

The depending wall structure on cap 60 is preferably configured to combine with the wall structure on the base 50 to promote air flow through the bearing assembly 40. In the exemplary embodiment illustrated in FIG. 4, cap 60 defines openings 68', 68" extending along lengthwise portions of opposed lateral sides thereof and extending between the ends 63 and 65. As will be appreciated, and after base 50 and cap 60 are arranged in operable combination relative to each other, the openings 58', 58" on base 50 and the openings 68', 68" on the cap or friction member 60, respectively, cooperate with each other to permit air to readily flow into and through the internal void or cavity 66 defined by bearing assembly 40.

When the side bearing assembly 40 is arranged in operable combination with the railcar 13 (FIG. 1), the elastomeric spring 70 is accommodated within the internal void or cavity 66 so as to develop a predetermined preload or suspension force that urges plate 61 of cap 60 toward and into substantially constant frictional engagement with the underside 42 of the car body 12. The preload or suspension force developed by spring 70 allows the side bearing assembly 40 to absorb, dissipate and return energy imparted thereto when the car body 12 tends to roll and furthermore inhibits hunting movements of the wheeled truck assembly 10 relative to the car body 12. Suffice it to say, spring 70 is designed to develop a preload force ranging between about 1,500 and about 9,000 pounds.

Spring 70 is preferably formed from a resiliently deformable block or column of elastomeric material having an elongated and generally rectangular shape in plan and which is capable of developing the required preload force for bearing assembly 40. In a preferred embodiment, the spring block or column is formed from a copolyesther polymer elastomer of the type manufactured and sold by the DuPont Company under the tradename HYTREL. Ordinarily, a HYTREL elastomer has inherent physical properties making it unsuitable for use as a spring. Applicants' assignee, however, has advantageously discovered it is possible to impart spring-like characteristics to a HYTREL elastomer. Coassigned U.S. Pat. No. 4,198,037 to D. G. Anderson better describes the above noted polymer material and forming process and is herein incorporated by reference. Suffice it to say, spring 70 is preferably formed from a thermoplastic material and has an elastic strain to plastic strain ratio greater than 1.5 to 1.

The elastomeric block forming spring 70 has a top surface 71, a bottom surface 72, two laterally spaced sides 73 and 74 (FIGS. 4 and 5), and two longitudinally spaced ends 75 and 76 (FIGS. 2 and 6). The deformable block of elastomeric material forming spring 70 furthermore defines a generally vertical axis 78 (FIG. 5) extending generally normal to the upper bolster surface 28 after the bearing assembly 40 is arranged in the internal cavity 66 (FIGS. 4 and 9) and in operable combination with the wheeled truck 10 (FIG. 1). As shown in FIG. 4, and after side bearing assembly 40 is arranged in operable combination with the railcar bolster 16, the top surface or upper end 71 of spring 70 is arranged in abutting engagement with the underside of the side bearing top plate 61. In the illustrated embodiment, the bottom surface or lower end 72 of spring 70 is permitted to extend through the cavity 58 in base 50 to abuttingly engage that portion of the upper bolster surface 28 surrounded by the walled receptacle 26. As will be appreciated, the bottom surface or lower end 72 of compression spring can be otherwise arranged without detracting or departing from the spirit and scope of the invention.

The compression spring 70 is designed such that, during a work cycle of bearing assembly 40, spring 70 deforms in a controlled and predetermined manner. When spring 70 is arranged within the internal void 66 of the bearing assembly 40 and little or no compressive load is placed thereon, the sides 73, 74 of spring 70 are spaced from and extend generally parallel with the sides 53, 54, respectively, on base 50. For reasons discussed below, and as shown in FIGS. 4 and 5, the laterally spaced sides 73 and 74 of spring 70 each have a generally concave configuration in elevation as long as a limited vertical load is imparted to the spring 70. As shown in FIG. 6, the longitudinally spaced ends 75, 76 of the spring 70 extend generally vertical and are disposed in generally parallel and spaced relationship relative to the ends 55, 56 (FIG. 2) of the side bearing base 50.

As shown in FIGS. 4, 5 and 6, the elastomeric compression spring 70 is preferably configured with a laterally widened upper portion 80 extending the length of the spring 70 and longitudinally between the spaced ends 75 and 76, a laterally widened lower portion 90 extending the length of the spring 70 and longitudinally between the spaced ends 75 and 76, and a narrowed mid-portion 100 extending the length of the spring 70 between the spaced ends 75 and 76 and along which the upper portion 80 and lower portion 90 are joined. In one form, the upper portion 80 and lower portion 90 of spring 70 are generally symmetrical relative to each other and relative to the vertical axis 78 (FIG. 5) defined by the deformable block or column of elastomeric material forming spring 70. In the embodiment illustrated in FIG. 5, the combined vertical heights of the first or upper portion 80, the second or lower portion 90, and the waist portion 100 comprise between about 80% to about 95% of a distance D between the top and bottom surfaces 71 and 72, respectively, of an uncompressed spring 70.

In the embodiment illustrated in FIG. 5, the widened upper portion 80 of spring 70 includes laterally spaced first and second sides 83 and 84, respectively. In the embodiment illustrated in FIG. 5, the widened lower portion 90 of spring 70 includes laterally spaced first and second sides 93 and 94, respectively. As shown in FIG. 4, the reduced waist portion 100 of spring 70, joins the upper and lower portions 80 and 90 of spring 70 and is positioned relative to the sides 53 and 54 on base 50 such that, upon maximum deflection, the sides 73, 74 of spring 70 remain in an operable relationship relative to the sides 53, 54 of the bearing housing or cage 50. As used herein and throughout, maintaining the sides 73, 74 of the spring 70 in an "operable relationship" relative to the sides 53, 54 of the side bearing assembly base 50 means the sides 73, 74 of spring 70 are either: preferably spaced from the sides 53, 54 of the spring assembly base 50; and/or are permitted to engage with the sides 53, 54 of the spring assembly base 50 to such an extent as to not adversely affect performance of the either the spring 70 and/or the side bearing assembly 40 during a work cycle of the side bearing assembly 40. Moreover, and during a work cycle of the side bearing assembly, the spring 70 is configured to deform in a predetermined manner toward the four corners 59*a*, 59*b*, 59*c* and 59*d* (FIG. 3) of the marginal edge 57 of the cavity 58 and toward the sides 53, 54 of the side bearing assembly base 50.

In the form shown in FIG. 5, the sides 83, 84 on the upper portion 80 of spring 70 are generally planar in configuration and angularly diverge outwardly at a predetermined angle from the reduced waist portion 100 along the length of the spring 70 as long as a limited vertical load is imparted to spring 70. Similarly, sides 93, 94 on the lower portion 90 of spring 70 are preferably planar in configuration and angularly diverge outwardly at a predetermined angle from the waist portion 100 along the length of the spring as a long a limited vertical load is imparted to the spring 70. Preferably, each side 83, 84 on the upper portion 80 of spring 70 extends from the mid-portion 100 and terminates proximate the top or upper surface 71 of the spring 70. Each side 83, 84 extends from the mid-portion 100 and is preferably disposed at approximately the same angle θ ranging between about 5° and about 20° relative to the vertical axis 78 defined by the deformable block or column of elastomeric material forming spring 70. Similarly, each side 93, 94 on the upper portion 90 of spring 70 extends from the mid-portion 100 and terminates proximate the bottom side or lower surface or end 72 of spring 70. Each side 93, 94 extends from the mid-portion 100 and is preferably disposed at approximately the same angle β ranging between about 5° and about 17° relative to the vertical axis 78 defined by the deformable block or column of elastomeric material forming spring 70. In a most preferred form, the angles θ and β defined by the sides 83, 84 and 93, 94, respectively, relative to the vertical axis 78 of the block of elastomeric material forming spring 70 are generally equal to each other.

As shown schematically in FIG. 5, the upper and lower portions 80 and 90, respectively, of spring 70 each define a minor axis 86 and 96, respectively. Each minor axis 86 and 96 extends generally normal to the vertical axis 78 defined by the deformable block or column of elastomeric material forming spring 70. Notably, the minor axes 86 and 96 defined by portions 80 and 90, respectively, of spring 70 are arranged in predetermined relation relative to the sides 53, 54 (FIG. 9) of the side bearing base 50.

Other features of the illustrated embodiment include interlocking the bearing cap 60 and spring 70 relative to each other. That is, the generally flat railcar engaging surface portion 61 of the bearing cap 60 and the upper surface 71 of the spring 70 preferably have interlocking instrumentalities, generally identified in FIG. 4 by reference numeral 110, for securing the resilient elastomeric block forming spring 70 and bearing cap 60 in operable combination relative to each other. As will be appreciated, by interlocking the bearing cap 60 and spring 70 in operable combination relative to each other, such an arrangement likewise positions the spring 70 relative to the base 50 of the side bearing assembly 40.

The interlocking instrumentalities 110 can take a myriad of different types for achieving the above-mentioned ends. In one form, shown in FIGS. 2 through 4, plate 61 of cap 60 defines a generally centralized and elongated throughbore 67 into which a portion 77 of spring 70 is received and captured. As shown in FIG. 3, the rectangular spring 70 is considerably larger in cross-sectional plan than is the opening 67. Preferably, projection 77 is longitudinally elongated and projects from the top surface 71 of and is integrally formed with the elastomeric block forming compression spring 70. The projection 77 on the elastomeric block is configured to be snugly accommodated within opening 67 in the bearing cap 60 so as to maintain the bearing cap 60 and spring 70 in operable combination relative to each other. Moreover, and as shown in FIG. 3, the ends 116, 118 of opening 67 on cap 60 serve as stops for limiting longitudinal displacement of the spring 70 relative to the cap 60 during a work cycle of the side bearing assembly 40.

Side bearing assembly 40 further includes an apparatus, generally indicated in FIGS. 2 and 8 by reference numeral 120. In a preferred form, apparatus 120 is arranged in operable combination with the bearing housing 50 and wall structure of the bolster housing or cage 26 for positively securing and positioning the side bearing assembly 40 relative to the truck bolster 16.

The apparatus 120 for positively securing and positioning the side bearing assembly 40 relative to the bolster 16 can take different forms without detracting or departing from the spirit and scope of the present disclosure. As mentioned, the side bearing assembly 40 is preferably sized to longitudinally fit loosely within recess 38 defined by the bolster receptacle 26. As shown in FIGS. 2 and 3, and after bearing assembly 40 is accommodated within the receptacle 26, the rigid and upstruck end walls 35 and 36 of the receptacle housing 26 are arranged in confronting but longitudinally spaced relation relative to the ends 55 and 56, respectively, of the bearing base or cage 50. Accordingly, an opening or gap 122 is preferably defined between the confronting walls 35, 55 and 36, 56, respectively, of the receptacle 26 and the bearing base or cage 50. As such, the side bearing assembly 40 is specifically designed to readily fit within recesses 38 of varying sizes on bolster 16, thus, enhancing the versatility to the railcar constant contact side bearing assembly.

In the illustrated embodiment, a locking insert or spacer 124 is snugly inserted into each opening 122 defined between the confronting walls 35, 55 and 36, 56, respectively, of the receptacle 26 and bearing housing 50. The locking insert or shim spacer 124 is secured, as by welding or a suitable mechanical device, preferably to the adjacent end wall of the receptacle 26 to inhibit longitudinal shifting movements of the bearing assembly 40 relative to the bolster 16.

As illustrated, each pair of confronting walls 35, 55 and 36, 56, respectively, disposed to opposed longitudinal sides of the side bearing axis 44 are preferably configured to further enhance securement of the bearing assembly 40 relative to the bolster 16. Preferably, each pair of confronting walls 35, 55 and 36, 56, respectively, disposed to opposed lateral sides of the axis 44 defined by the bearing assembly 40 defines a surface portion 86 (FIG. 8) that is inclined with respect to the confronting surface 88 such that surfaces 86 and 88 angularly diverge relative to each other and away from the upper surface 28 of the bolster 16 so as to provide the opening 122 with a generally wedge-shape. To enhance its reception and retention within the preferably wedge-shaped opening 122, each insert 124 likewise preferably has a wedge-shape.

In those embodiments of the bearing assembly having a bottomless housing design, spring 70 is permitted to extend through the bottom of the bearing cage 50 to directly abut and engage the upper surface 28 of the bolster 16. As such, the vertical space normally consumed or taken by the bottom of the bearing assembly cage or housing has been eliminated and advantageously used to reduce the overall height of and provide a low profile to the bearing assembly 40. Whereas, in one form of bearing assembly 40, the measurable distance between the upper friction engaging surface 62 of assembly 40 and the lowermost wall structure surface of the cage 50 ranges between about 2.5 inches and about 4.5 inches. In another design, the bottomless design of the cage 50 yields a bearing assembly having a side profile measuring about 2.625 inches in overall height.

Another important feature of the present disclosure involves maintaining the friction surface 62 of assembly 40 in substantially constant contact with the underside 42 of the railcar body 12. As such, hunting or yawing motions of the wheeled truck 10 are inhibited, thus, yielding improved performance to the railcar. Moreover, when rolling movements of the railcar body 12 are excessive, the side bearing assembly 40 of the present disclosure allows the car body to "go solid" into the bolster 16 through contact between the car body underside 42 and the upper surface 52 on the side bearing assembly base 50 whereby limiting damages to and, thus, prolonging the life of the side bearing assembly 40.

In addition to the above, the side bearing assembly 40 is configured to be accommodated within existing housing structures on the bolster. As such, there is no need to spend valuable time removing or cutting away the existing housing structure on the bolster. In a preferred embodiment, the side bearing assembly 40 is configured to loosely fit within different size pockets defined by the existing housing or receptacle on the bolster 16. Thereafter, apparatus 120 is used to positively locate and secure the constant contact side bearing assembly 40 in the pocket 38 defined by and relative to the railcar bolster 16.

Another favorable aspect relates to the ability to control deformation of spring 70 during a side bearing assembly work cycle. As will be appreciated, if the sides 73, 74 of the elastomeric spring 70 deform, upon compression of the spring 70, to such an extent that either meaningfully engages the sides 53, 54 of the spring assembly base 50, the ability of the spring 70 to operate in the manner which it was designed is adversely compromised—if not lost. The relatively large loads or forces applied to the spring 70, during a side bearing assembly work cycle, coupled with the restricted space constraints defined by the internal void 66, wherein the spring 70 is arranged, tend to teach away from the use of elastomeric springs in side bearing applications.

During a work cycle of the side bearing assembly 40, the top plate 61 of cap 60 moves toward the base 50, under the influence of the car body 12 pressing downwardly thereon, thus further diminishing the already shortened height, and the already limited area of the internal void 66 into which spring 70 is permitted to deform. As shown in FIG. 9, when a significant compressive load is imparted to the side bearing assembly to an extent where the side bearing assembly "goes solid", the area of the internal void 66 into which spring 70 is permitted to deform is still further reduced compared to when little or no load is placed on the spring 70. As a result of the compressive forces exerted thereon, the laterally spaced sides 73, 74 of spring 70 bulge or deform outwardly toward the sides 53, 54 of the side bearing assembly base 50 (FIG. 3). Moreover, the longitudinally spaced ends 75, 76 of spring 70 deform horizontally toward the ends 55, 56 and corners 59*a*, 59*b*, 59*c* and 59*d* of the side bearing assembly base 50 (FIG. 3). An mentioned, base 50 is configured to have significantly greater strength in the longitudinal direction than in the lateral direction. Accordingly, deformation or bulging of the spring 70 horizontally toward the ends 55, 56 and corners 59*a*, 59*b*, 59*c* and 59*d* (FIG. 3) of the side bearing assembly base 50 only serves to enhance performance of the side bearing assembly 40.

The bulging of the sides 73, 74 of the spring 70, however, laterally toward the sides 53, 54, respectively, of the side bearing assembly base 50 is a serious concern. The spring design of this disclosure, however, controls the lateral displacement of the spring 70 while permitting displacement or bulging of the spring 70 horizontally toward the ends 55, 56 and corners 59*a*, 59*b*, 59*c* and 59*d* of the side bearing assembly base 50. Moreover, the spring design of this disclosure, controls the lateral displacement of the spring 70 relative to the sides 53, 53 of the side bearing assembly base 50 in response to a significant compressive load being imparted to the spring 70 by the cap 60 during a work cycle of the side bearing assembly 40.

The concave configuration of only the sides 73, 74 of the spring 70 limits lateral displacement or bulging of the spring 70 such that, upon maximum lateral deflection of the spring 70 toward the sides 53, 54 of the side bearing assembly base or housing 50, the sides 73, 74 of the spring 70 remain in an operable relationship relative to the housing assembly 46, thus, ensuring proper functioning of the side bearing assembly 40 during a work cycle of the side bearing assembly 40. Moreover, and as shown in FIG. 9, the side surfaces 73, 74 of the spring 70 are positionally arranged and configured relative to the sides of the sides 53, 54 of the side bearing assembly base 50. As a result, side surfaces 83, 84 of the upper portion 80 and the side surfaces 93, 94 of the lower portion 90 surprisingly bulge outwardly along their respective minor axes 86 and 96, respectively, and in positional relationship relative to the sides 53, 54 of the bearing housing or cage 50, thus, further ensuring proper functioning of the side bearing assembly 40 during a work cycle of the side bearing assembly 40.

From the foregoing, it will be observed numerous modifications and variations can be made and effected without departing or detracting from the true spirit and novel concept of the present disclosure. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A constant contact side bearing assembly for a railcar having an elongated body, with said side bearing assembly being adapted to be accommodated within a multiwalled receptacle defining an elongated and open top recess, said receptacle including a pair of laterally spaced sidewalls rigidly joined to a pair of longitudinally spaced endwalls, and with the sidewalls and endwalls of said receptacle being arranged in upstanding relation relative to a bolster on which said elongated body of said railcar is carried, said constant contact side bearing comprising:

a base adapted to be accommodated between the upstanding sidewalls and endwalls of said recess defined by said receptacle on said bolster, with said base including a pair of laterally spaced sides adapted to extend generally parallel to the sidewalls on said receptacle and which are rigidly joined to a pair of longitudinally spaced ends adapted to extend generally parallel to the endwalls on said receptacle, with the sides and ends of said base defining a closed marginal edge for an open top cavity, generally rectangular in plan, and having four corners;

a friction member guided for movements relative to said base and having a generally flat upper portion adapted to biased against an underside of the elongated body of said railcar after said side bearing assembly is arranged in operable combination with said railcar; and an elastomeric spring, generally rectangular in plan, with two side surfaces and two end surfaces extending between two vertically spaced surfaces, with said spring being adapted to be nested within the open top cavity defined by and between the sides and ends of said base for absorbing, dissipating and returning energy imparted to the upper portion of said friction member during a work cycle of said side bearing assembly, and with one of said two side surfaces and two end surfaces of said elastomeric spring having a generally convex shaped configuration extending predominately between the vertically spaced surfaces, and with one of said two side surfaces and two end surfaces of said elastomeric spring having a concave shaped configuration extending predominantly between the spaced vertical surfaces such that, upon application of a sufficiently downwardly directed force on said friction member, said spring deforms in a predetermined manner horizontally toward the four corners of the marginal edge defining said cavity while deformation of the side surfaces of said elastomeric spring is restrained so as to maintain an operable relationship between the spring and the sides of said base during a work cycle of said side bearing assembly.

2. The constant contact side bearing assembly according to claim 1, wherein said elastomeric spring and said friction member are arranged in interlocking relation with each other.

3. The constant contact side bearing assembly according to claim 1, further including an apparatus operably engagable with said multiwalled receptacle and said base for locating said bearing assembly relative to said bolster.

4. The constant contact side bearing assembly according to claim 1, wherein said base is configured such that one end of said spring extends through said base and engages with that surface on said bolster from which the sidewalls and endwalls of said receptacle upwardly extend.

5. The constant contact side bearing assembly according to claim 1, wherein each end surface of said spring has a generally convex shaped configuration extending between the vertically spaced surfaces and along a width of said spring.

6. The constant contact side bearing assembly according to claim 1, wherein each side surface of said elastomeric spring has a concave shaped configuration extending predominantly between the the spaced vertical surfaces and along a length of said spring.

7. A constant contact side bearing assembly for a railcar having an elongated body, with said side bearing assembly being adapted to be accommodated within a multiwalled receptacle defining an elongated and open top recess, said receptacle including a pair of laterally spaced sidewalls rigidly joined to a pair of longitudinally spaced endwalls, and with the sidewalls and endwalls of said receptacle being arranged in upstanding relation relative to a bolster on which said elongated body of said railcar is carried, said constant contact side bearing comprising:

a base adapted to be accommodated between the upstanding sidewalls and endwalls of said recess defined by said receptacle on said bolster, with said base including a pair of laterally spaced sides adapted to extend generally parallel to the sidewalls on said receptacle and which are rigidly joined to a pair of longitudinally spaced ends adanted to extend generally parallel to the endwalls on said receptacle, with the sides and ends of said base defining a closed marginal edge for an open top cavity, generally rectangular in plan, and having four corners;

a friction member guided for movements relative to said base and having a generally flat upper portion adapted to biased against an underside of the elongated body of said railcar after said side bearing assembly is arranged in operable combination with said railcar; and an elastomeric spring, generally rectangular in plan, adapted to be nested within the open top cavity defined by and between the sides and ends of said base for absorbing, dissipating and returning energy imparted to the upper portion of said friction member during a work cycle of said side bearing assembly, wherein said elastomeric spring defines an upper portion, extending the length of said spring, a lower portion, extending the length of said spring, and a reduced midportion, extending the length of said spring and along which said upper portion and lower portion of said spring are joined, and wherein said elastomeric spring is configured to deform in a predetermined manner horizontally toward the four corners of the marginal edge defining said cavity while deformation of the sides of said elastomeric spring is restrained so as to maintain an operable relationship between the spring and the sides of said base during a work cycle of said side bearing assembly.

8. The constant contact side bearing assembly according to claim 7, wherein the upper and lower portions of said spring are generally symmetrical relative to a vertical axis defined by said spring.

9. The constant contact side bearing assembly according to claim 8, wherein the upper and lower portions of said spring each define a minor axis extending generally normal to said vertical axis and along which said spring deforms under compression.

10. The constant contact side bearing assembly according to claim 9, wherein the minor axis of each of said upper and lower portions of said spring is arranged in predetermined relation relative to the sides of the base of said side bearing assembly.

11. A constant contact side bearing assembly for insertion between a railcar body and a railcar bolster supporting said railcar body, with an upper surface of said bolster having an open top walled receptacle thereon for accommodating said constant contact side bearing, said constant contact side bearing comprising:

a generally rectangularly shaped walled housing receivable within the open top walled receptacle on said bolster, said walled housing having laterally spaced sides and longitudinally spaced ends defining a four cornered marginal edge, generally rectangular in plan, of an open top cavity;

a cap arranged for absorbing, dissipating and returning energy imparted to said side bearing assembly, said cap having a generally flat railcar body engaging portion and structure which, during a work cycle of said side bearing assembly, combines with said sides and ends on said walled housing to telescopically guide said cap relative to said walled housing; and a longitudinally elongated and generally rectangularly-shaped elastomeric spring having laterally spaced and longitudinally extending sides along with longitudinally spaced ends between two vertically spaced spring surfaces, with said elastomeric spring being receivable within the cavity defined by said walled housing such that an upper surface of said elastomeric spring engages an underside of the flat railcar body engaging portion of said cap so as to resiliently and continually urge the flat railcar body engaging portion of said cap against the car body, with each end of the spring having a generally convex shaped configuration extending predominately between the two vertically spaced spring surfaces and along a width of said spring, and wherein each side of said spring has a concave shaped configuration in elevation extending predominately between the two vertically spaced surfaces on said spring, with each concave side of said spring being configured relative to the laterally spaced sides of said walled housing such that when a sufficient downward force is applied to the generally flat railcar body engaging portion of said cap said spring deforms in a predetermined manner horizontally toward the four corners of the marginal edge defining said cavity while the sides of said elastomeric spring are maintained in an operable relationship relative to the sides of the walled housing during a work cycle of said side bearing assembly.

12. The constant contact side bearing assembly according to claim 11 further including an apparatus for locating and securing said side bearing assembly within said receptacle on said railcar bolster.

13. The constant contact side bearing assembly according to claim 11, wherein the generally flat railcar body engaging portion on said cap and an upper end of said spring are configured with interlocking instrumentalities for securing said elastomeric spring and said cap in operable combination relative to each other.

14. The constant contact side bearing assembly according to claim 11, wherein said spring has an upper portion between said laterally spaced sides, a lower portion between said laterally sides, and a reduced waist portion extending between and joining said upper and lower portions of said spring to each other and which is elevationally positioned relative to the sides on said walled housing such that, when deformed, the exterior sides of said spring avoid contact with the sides of said walled housing.

15. The constant contact side bearing assembly according to claim 14, wherein the sides of the upper portion of said elastomeric spring angularly converge toward each other at a predetermined angle and toward the waist portion of said spring along the length of said spring as long as a limited or no load is vertically placed on said spring.

16. The constant contact side bearing assembly according to claim 15, wherein the sides of the lower portion of said elastomeric spring angularly converge toward each other at a predetermined angle and toward the waist portion of said spring along the length of said spring as long as a limited or no load is vertically placed on said spring.

17. The constant contact side bearing assembly according to claim 16, wherein the sides of the upper portion of said elastomeric spring and the sides of the lower portion of said elastomeric spring are generally symmetrical relative to each other.

18. The constant contact side bearing assembly according to claim 11, wherein said walled housing is open at top and bottom sides thereof so as to allow one end of said elastomeric spring to extend therethrough and abuttingly engage with the upper surface of said bolster whereby minimizing a distance between the flat railcar engaging portion of said cap and the upper surface of said bolster.

19. A constant contact side bearing assembly configured for insertion into an upwardly open walled receptacle provided on a railcar bolster connected to a wheeled truck and which supports a railcar body, said constant contact side bearing assembly comprising:

a longitudinally elongated housing assembly having a generally rectangular configuration in plan and which is configured to fit within the walled receptacle on said bolster, said housing assembly defining an internal void having a closed margin, generally rectangular in plan, and wherein said housing assembly includes a pair of laterally spaced generally parallel sides and an upper friction surface;

a longitudinally elongated elastomeric compression spring operably fitted within the internal void of said housing assembly for resiliently biasing said upper friction surface against an underside of the railcar body to limit hunting movements of the wheeled truck, said elastomeric spring having a generally rectangular configuration in plan and includes a pair of ends and a pair of elongated and laterally spaced sides extending between two vertically spaced spring surfaces, with the sides of said spring extending generally parallel the laterally spaced sides on said housing assembly after said elastomeric spring is arranged in operable combination with said housing assembly, and wherein each of said two ends of said elastomeric spring has a generally convex shaped configuration extending predominately between said two vertically spaced spring surfaces, and wherein each side of said spring has a concave shape extending the majority of a distance separating said two vertically spaced spring surfaces, with the concave shape on each side of the spring being configured in positional relation relative to said sides on said housing such that, upon spring deformation, volumetric displacement of said spring relative to the marginal edge defining the internal void within said housing assembly and the sides of said housing assembly is controlled in a predetermined manner to optimize load absorption capability for said constant contact spring assembly; and an apparatus for locating and securing the housing assembly of said side bearing assembly within said walled receptacle on said railcar bolster.

20. The constant contact side bearing assembly according to claim 19, wherein said elastomeric compression spring includes an upper portion comprising approximately 30% to about 45% of the distance between said vertically spaced spring surfaces, a lower portion comprising approximately 30% to about 45% of the distance between said vertically spaced spring surfaces, and a waist portion extending between and joining said upper and lower portions of said spring to each other and which is elevationally positioned relative to the sides on said housing assembly.

21. The constant contact side bearing assembly according to claim 20, wherein a distance ranging between about 2.5 inches and about 4.5 inches is provided between the upper friction surface of said housing assembly and a bottom edge of said housing assembly.

* * * * *